US009052630B2

(12) United States Patent
Kadowaki

(10) Patent No.: US 9,052,630 B2
(45) Date of Patent: Jun. 9, 2015

(54) ELECTROSTATIC CHARGER AND IMAGE FORMING APPARATUS

(75) Inventor: Hideaki Kadowaki, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 147 days.

(21) Appl. No.: 13/701,418

(22) PCT Filed: Apr. 26, 2011

(86) PCT No.: PCT/JP2011/060128
§ 371 (c)(1),
(2), (4) Date: Nov. 30, 2012

(87) PCT Pub. No.: WO2011/152159
PCT Pub. Date: Dec. 8, 2011

(65) Prior Publication Data

US 2013/0071142 A1 Mar. 21, 2013

(30) Foreign Application Priority Data

Jun. 2, 2010 (JP) ..... 2010-126519

(51) Int. Cl.
*G03G 15/02* (2006.01)
*H05F 1/00* (2006.01)

(52) U.S. Cl.
CPC ..... *G03G 15/0208* (2013.01); *G03G 2215/027* (2013.01); *H05F 1/00* (2013.01); *G03G 15/0291* (2013.01)

(58) Field of Classification Search
CPC ..... G03G 9/09716; G03G 15/0874; G03G 15/08; G03G 21/18; G03G 9/08755; G03G 9/08797; G03G 9/09725; G03G 15/0882; G03G 15/0898; G03G 21/1633; G03G 2215/0132; G03G 5/0614; G03G 9/08; G03G 9/0827; G03G 9/08782
USPC ..... 399/100, 101, 176, 111, 106, 262, 159
See application file for complete search history.

(56) References Cited

U.S. PATENT DOCUMENTS

| | | | | |
|---|---|---|---|---|
| 8,050,590 | B2 * | 11/2011 | Parks | 399/100 |
| 2006/0233568 | A1 | 10/2006 | Itabashi et al. | |
| 2007/0223961 | A1 * | 9/2007 | Takamatsu | 399/111 |

FOREIGN PATENT DOCUMENTS

| | | | |
|---|---|---|---|
| JP | 63-265258 | A | 11/1988 |
| JP | 8-262840 | A | 10/1996 |
| JP | 8-297396 | A | 11/1996 |
| JP | 2006-276222 | A | 10/2006 |
| JP | 2008-139522 | A | 6/2008 |

* cited by examiner

*Primary Examiner* — Roy Y Yi
(74) *Attorney, Agent, or Firm* — Birch, Stewart, Kolasch & Birch, LLP

(57) ABSTRACT

An electrostatic charger includes a discharge electrode which has a long shape and a housing. The housing has a U-shaped cross section in a direction perpendicular to a longitudinal direction of the discharge electrode, receives the discharge electrode and supports the discharge electrode in a direction such that a tip portion thereof is disposed on an open face side. The housing includes a first member and a second member separated from each other at a border that includes an electrode-supporting section supporting the discharge electrode, and the first member and the second member are attachable to and detachable from each other.

7 Claims, 12 Drawing Sheets

ELECTROSTATIC CHARGER AND IMAGE FORMING APPARATUS

TECHNICAL FIELD

The present invention relates to an electrostatic charger installed in an image forming apparatus in accordance with the electrophotography method and used in order to charge a surface of an image bearing member, and to an image forming apparatus provided with the same.

BACKGROUND ART

In an image forming apparatus in accordance with the electrophotography method, a surface of an image bearing member is charged with electricity uniformly by an electrostatic charger, then an electrostatic latent image based on image data is formed on the surface of the image bearing member by an exposure device, then a developer is supplied to the electrostatic latent image by a developing device, and thereby an electrostatic latent image is developed.

The electrostatic charger installed in such an image forming apparatus is provided with a housing of which one side facing the image bearing member is open having a U-shaped cross section, and a discharge electrode is disposed inside the housing (for example, refer to Patent Literature 1).

CITATION LIST

Patent Literature

[Patent Literature 1]
Japanese Patent Unexamined Publication No. 2008-139522 bulletin

SUMMARY OF INVENTION

Technical Problem

For this reason, it is hard to carry out a task to the inside of the housing since an interior of the housing is a narrow space surrounded by two side faces and a bottom face of the housing. In particular, it has been difficult to install the discharge electrode in the housing because an electrode-supporting section of the housing to which the discharge electrode is installed is located at a portion nearer to the bottom face than the tip portion of the housing as a result of a direction of the discharge electrode that is supported inside the housing in such a manner that its tip portion faces the image bearing member, which has made the manufacture of an electrostatic charger not easy.

The present invention is directed to providing an electrostatic charger and an image forming apparatus that are easy to manufacture.

Solution to Problem

An electrostatic charger of the present invention includes a discharge electrode which has a long shape and a housing. The housing has a U-shaped cross section in a direction perpendicular to a longitudinal direction of the discharge electrode, and receives the discharge electrode supporting thereof in a direction such that a tip portion thereof is disposed facing an open face's side of the housing. The housing includes a first member and a second member separated from each other at a border that includes the electrode-supporting section supporting the discharge electrode, and the first member and the second member are attachable to and detachable from each other.

With this configuration, the housing has the U-shaped cross section in the direction perpendicular to the longitudinal direction of the discharge electrode. Therefore, the discharge electrode is disposed in a narrow space surrounded by two side faces and a bottom face of the housing. Also, the discharge electrode, being supported in the direction such that the tip portion thereof is disposed facing the open face side of the housing, the electrode-supporting section is disposed on the more distant side than the tip portion in relation to the open face of the housing in an attached state where the first member and the second member are attached to each other. In other words, the electrode-supporting section is disposed on the bottom side of the housing as compared with the tip portion. On the other hand, in a detached state where the first member and the second member are detached from each other, the discharge electrode is installed on either the first member or the second member. Also, since the first member and the second member are separated from each other at the border that includes the electrode-supporting section, the electrode-supporting section is exposed to outside in the detached state. Therefore, the discharge electrode can easily be installed to the housing.

In the above mentioned configuration, the housing has an opening section that is provided on a face opposite the open face and that is a slit-like opening section penetrating form the inside to the outside, and thus one side face of the opening section can be configured so as to constitute the electrode-supporting section. Because an opposite side face of the opening section closely faces the electrode-supporting section in the attached state and a distance between the side faces of the opening section is small, workability to the side faces of the opening section is low; however, workability to the electrode-supporting section increases since the electrode-supporting section is exposed to outside by getting the first member and the second member detached from each other. Therefore, the discharge electrode can easily be installed to the housing. Besides, with the discharge electrode installed on the side face of the opening section, ozone which is generated around the discharge electrode becomes more likely to be discharged, and thus sticking of inessentials such as nitrogen oxides to the discharge electrode is suppressed, thereby suppressing failure in the electrostatic charge.

Advantageous Effects of Invention

The present invention makes it possible to easily produce an electrostatic charger and an image forming apparatus provided with the same.

DESCRIPTION OF EMBODIMENTS

An embodiment to implement the present invention is explained below based on the drawings.

Figure 1:
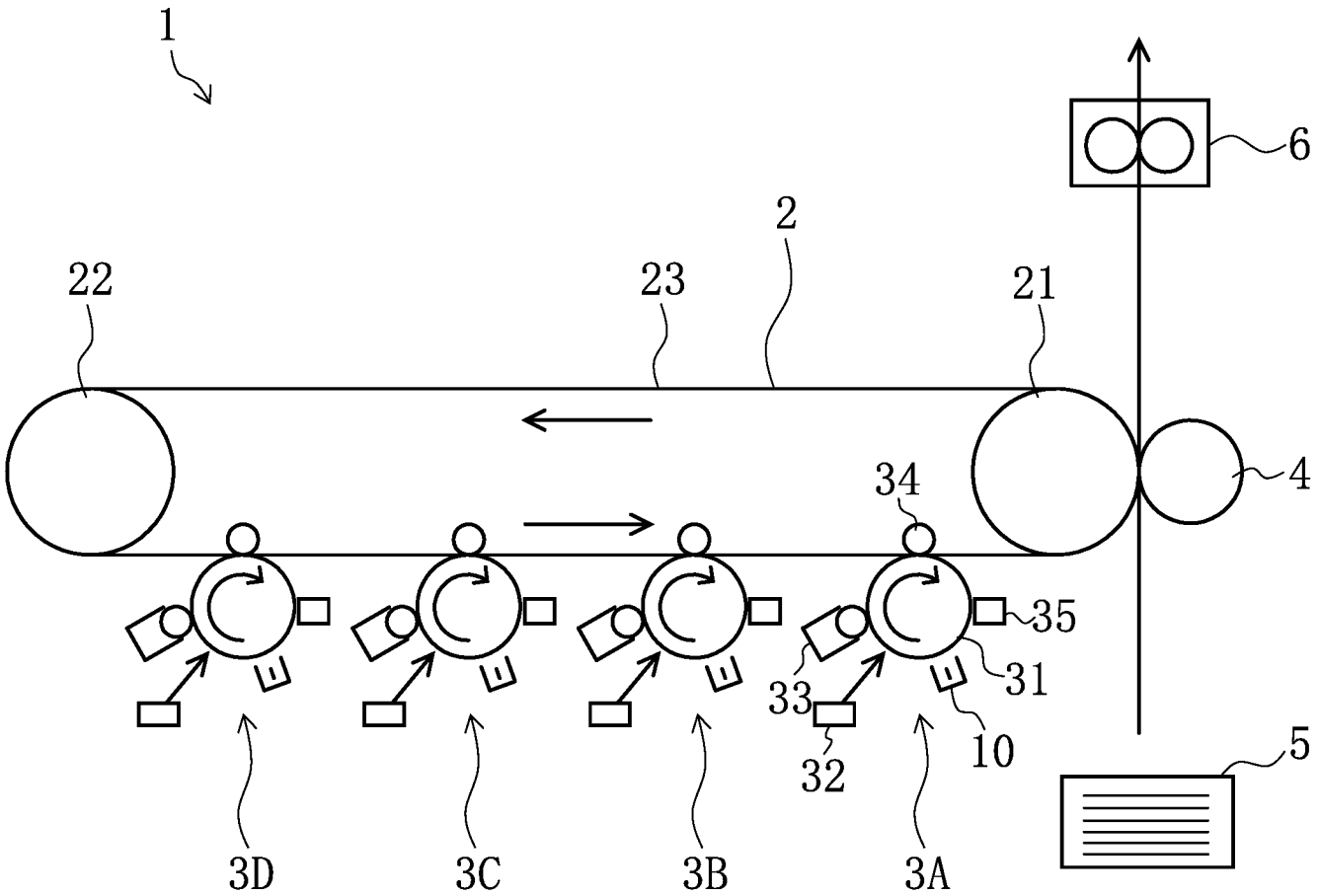
FIG. 1 is a general configuration diagram of an image forming apparatus provided with an electrostatic charger according to an embodiment of the present invention.

As shown in FIG. 1, an image forming apparatus 1 includes an intermediate transfer unit 2, four image forming sections 3A, 3B, 3C, 3D, a secondary transfer roller 4, a paper feeding section 5 and a fuser unit 6, and forms an image onto a paper sheet through an image forming process in accordance with the electrophotography method based on image data. For the paper, normal paper, OHP film, photographic paper and the like can be exemplified.

The intermediate transfer unit 2 includes a drive roller 21, an idle roller 22 and an intermediate transfer belt 23. The intermediate transfer belt 23 is formed with an endless belt, and is passed over the drive roller 21 and the idle roller 22 and tensioned therewith, forming a loop-like path of movement.

The image forming sections 3A through 3D are disposed along the intermediate transfer belt 23 on the upstream side of the drive roller 21 in a direction of movement of the intermediate transfer belt 23. The image forming sections 3A through 3D form toner images of hues of black, cyan, magenta and yellow, respectively. The image forming section 3B for cyan, the image forming section 3C for magenta and the image forming section 3D for yellow are configured in the same manner as the image forming section 3A for black.

The image forming section 3A includes a photoreceptor drum 31, an electrostatic charger 10 disposed on a periphery of the photoreceptor drum 31, an optical scanner 32, a developing device 33, a primary transfer roller 34 and a cleaning unit 35.

The photoreceptor drum 31 has a photosensitive layer on its circumferential surface, and constitutes an image bearing member. The photoreceptor drum 31 is disposed in such a manner that its axial direction is parallel to a width direction of the intermediate transfer belt 23, that is to say, an axial direction of the drive roller 21. The electrostatic charger 10 has a length equal to a length in the axial direction of the photoreceptor drum 31, and is disposed so as to parallelly face a rotating shaft of the photoreceptor drum 31. The electrostatic charger 10 charges the circumferential surface of the photoreceptor drum 31 uniformly.

The optical scanner 32 forms an electrostatic latent image on the circumferential surface of the photoreceptor drum 31 based on the image data for the corresponding hue. The developing device 33 develops the electrostatic latent image and forms a toner image by supplying a toner (developer) of the corresponding hue to the circumferential surface of the photoreceptor drum 31. The primary transfer roller 34 is disposed so as to face the photoreceptor drum 31 across the intermediate transfer belt 23, and performs a primary transfer of the toner image formed on the circumferential surface of the photoreceptor drum 31 onto an outer peripheral surface of the intermediate transfer belt 23.

The black, cyan, magenta and yellow tonner images formed on the respective image forming sections 3A through 3D undergo the primary transfer onto the peripheral surface of the intermediate transfer belt in such a manner as to be superimposed one another sequentially, and then are conveyed by the intermediate transfer belt 23.

The secondary transfer roller 4 is disposed so as to be in contact with the drive roller 21 with pressure sandwiching the intermediate transfer belt 23 in between. The paper feeding TO section 5 receives the paper sheets. To the secondary transfer region where the secondary transfer roller 4 and the intermediate transfer belt 23 are in contact with each other with pressure, paper sheets are supplied piece by piece with a predetermined timing from the paper feeding section 5. The secondary transfer roller 4 performs a secondary transfer of the toner image borne on the peripheral surface of the intermediate transfer belt 23 onto the paper sheet.

The fuser unit 6 heats and presses the paper sheet, thereby fixing the toner image durably on the paper sheet. The paper sheet on which the toner image has been fixed is discharged to a paper receiving tray not illustrated.

Figure 2:
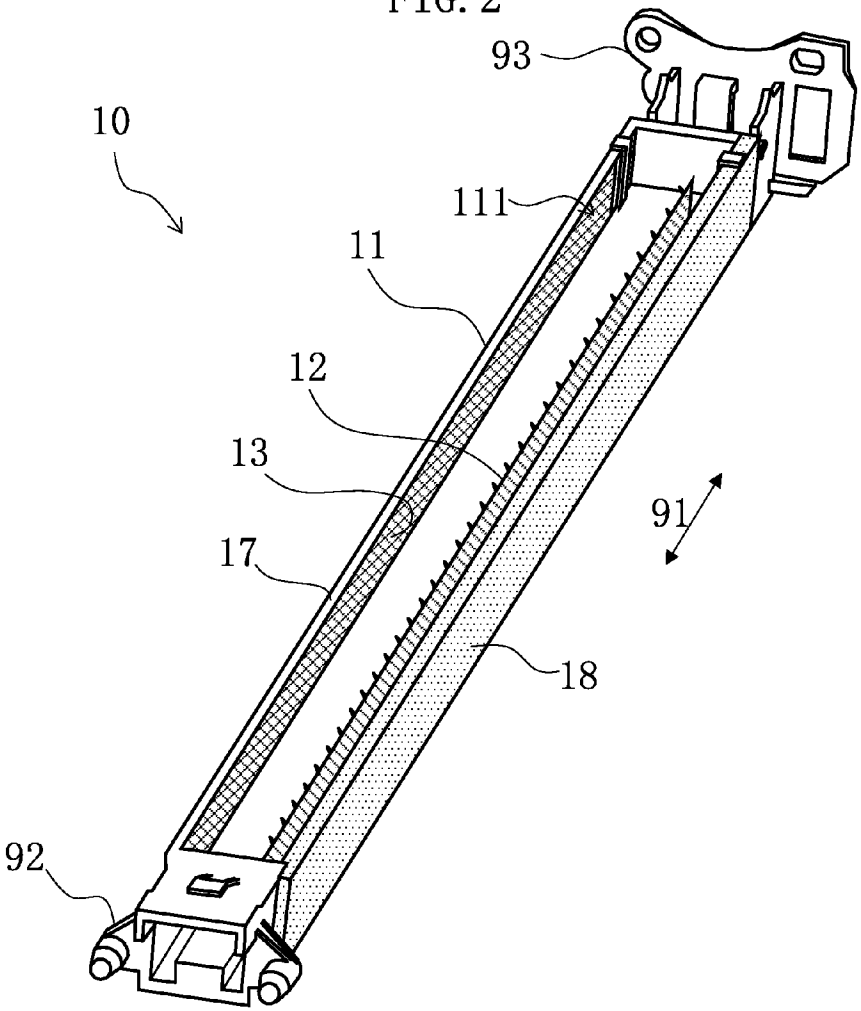
FIG. 2 is a perspective view of the electrostatic charger.
Figure 3:
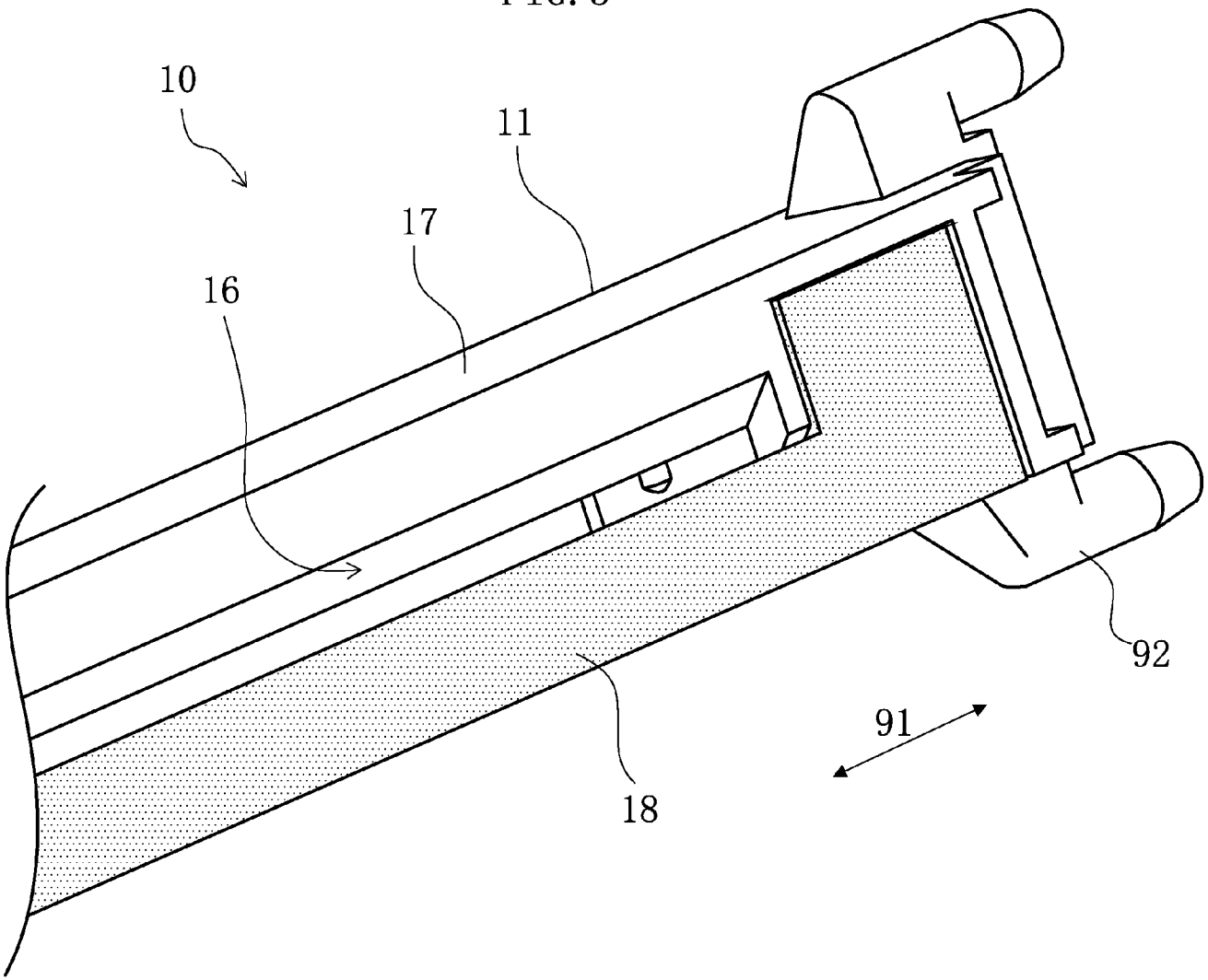
FIG. 3 is a perspective view from a rear face's side of a first end portion of the electrostatic charger.
Figure 4:
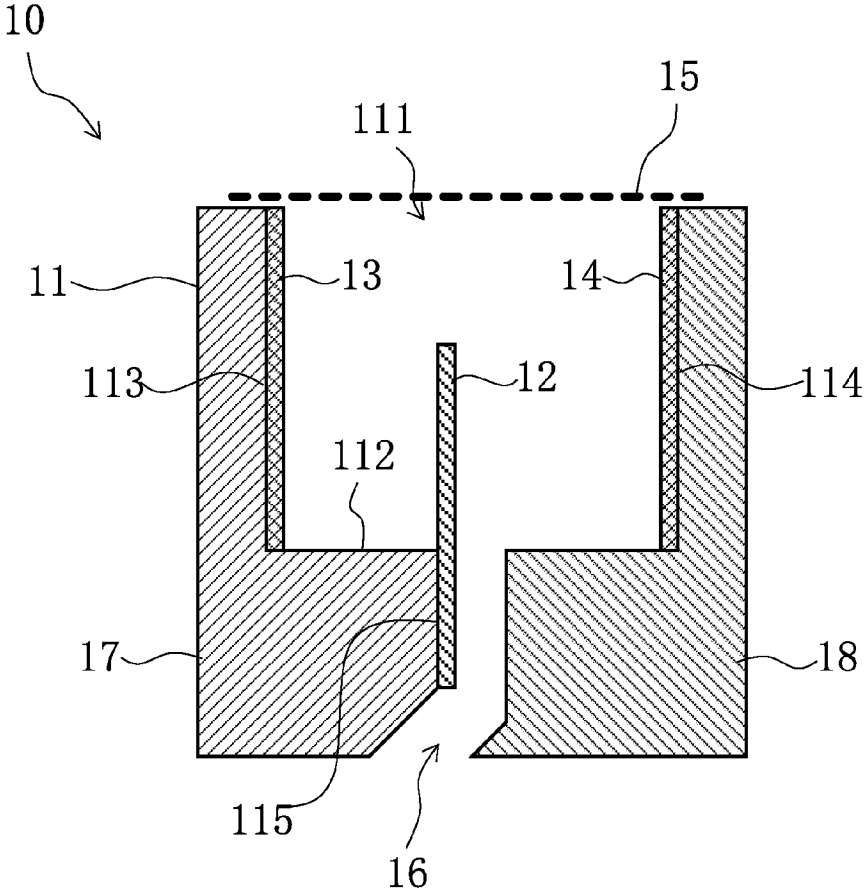
FIG. 4 is a general sectional view in the direction perpendicular to a longitudinal direction of the electrostatic charger.

As shown in FIG. 2 through FIG. 4, the electrostatic charger 10 includes a housing 11, a discharge electrode 12, conductive members 13, 14 and a grid electrode 15 each of which has a long shape. Here, in FIGS. 2, 3, 7, 8, 9, 11, for the convenience of explanation, distinguishing symbols such as hatching or the like is put to some components to facilitate discernment between the components.

The housing 11 is made of resin, and has a U-shaped cross section in a direction perpendicular to a longitudinal direction 91, with two inner side faces 113, 114 and an inner bottom face 112, and an open face 111 that is disposed toward a direction facing the photoreceptor drum 31.

The housing 11 has a slit-like opening section 16 penetrating from the inside to the outside of the housing 11 on the inner bottom face 112 which is a face opposite the open face 111. The opening section 16 is provided along the longitudinal direction 91 generally in the whole length of the housing 11. The length of the opening section 16 in the longitudinal direction 91 is longer than that of the discharge electrode 12 only by a margin for installation.

The housing 11 receives the discharge electrode 12, and supports the discharge electrode 12 in a direction such that a tip portion of the discharge electrode 12 is disposed facing an open face 111's side. The housing 11 includes a first member 17 and a second member 18 separated from each other at a border that includes an electrode-supporting section 115 supporting the discharge electrode 12. The first member 17 and the second member 18 are attachable to and detachable from each other. For example, the first member 17 and the second member 18 are attached to and detached from each other by fitting. Still, the second member 18 can also be attached to the first member 17 with screws. The opening section 16 is formed between the first member 17 and the second member 18.

For the discharge electrode 12, for example, a saw-toothed electrode is used. The discharge electrode 12 is installed on the electrode-supporting section 115 of the first member 17. In the embodiment, the electrode-supporting section is chosen at a region parallel to the inner side face 113 of the housing 11 among side faces of the first member 17's side of the opening section 16. As an example, the discharge electrode 12 is positioned by fitting holes 121 provided at a plurality of positions in the discharge electrode 12 onto protruded portions 171 provided in the electrode-supporting section of the first member 17, and then the discharge electrode 12 is bonded to the electrode-supporting section 115 throughout its entire length with an adhesive.

Once the discharge electrode 12 is installed on the side face of the opening section 16, the position at which the discharge electrode 12 is installed is located in an air current that flows in from the opening section 16 and is discharged to the open face 111. Therefore, not only does ozone that is generated around the discharge electrode 12 at the time of electric discharge become more likely to be discharged outside the housing 11, but also fresh air becomes more likely to be supplied around the discharge electrode 12 from outside the housing 11, and thus sticking of inessentials such as nitrogen oxides to the discharge electrode 12 is suppressed, thereby suppressing failure in electrostatic charge on the circumferential surface of the photoreceptor drum 31.

Because the discharge electrode 12 is supported by the housing 11 in the direction such that the tip portion is disposed on the open face 111's side, the electrode-supporting section 115 is disposed on the more distant side than the tip portion of the discharge electrode 12 in relation to the open face 111 in the attached state where the first member 17 and the second member 18 are attached to each other. That is to say, the electrode-supporting section 115 is disposed on the inner bottom face 112's side of the housing 11 as compared with the tip portion of the discharge electrode 12. In particular, since the side face opposite the opening section 16 faces the electrode-supporting section 115 in its neighborhood in the attached state, a gap between the side faces of the opening section 16 is narrow. In this manner, in the attached state, the electrode-supporting section 115 is disposed in a narrow space in the housing 11.

Figure 5:
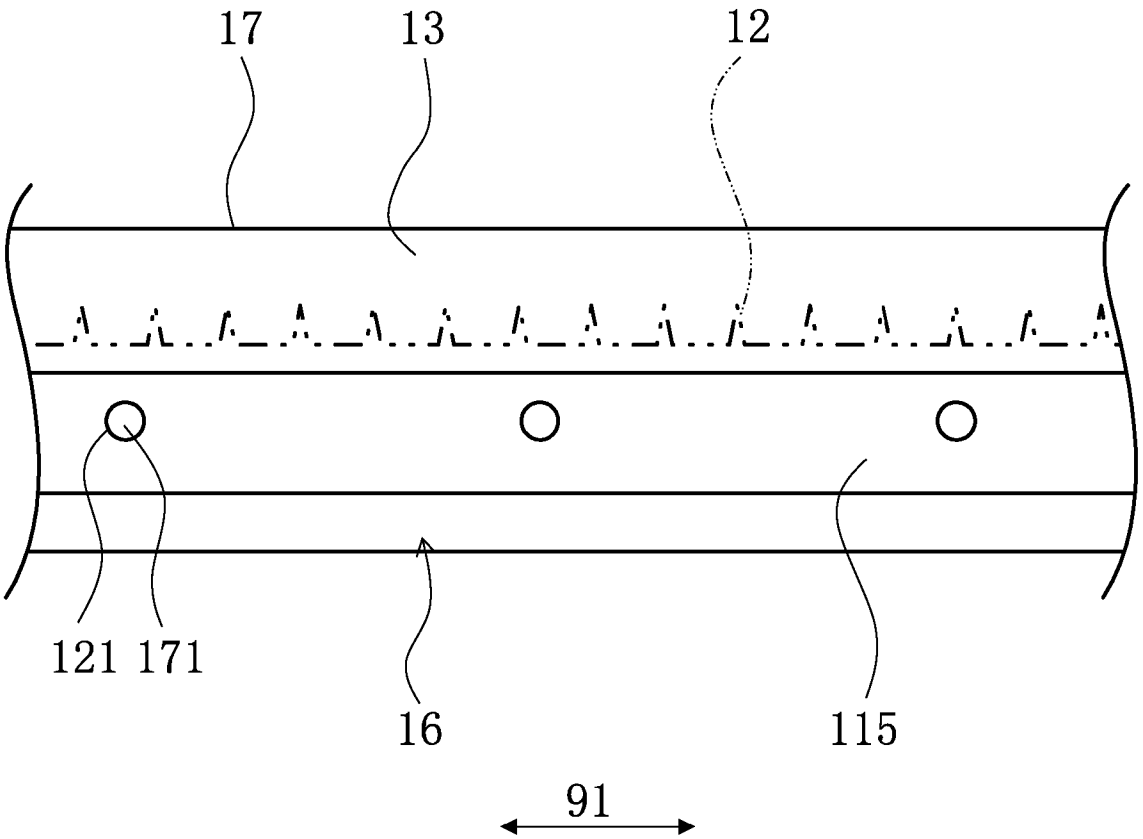
FIG. 5 is a side view showing part of a first member in a detached state.

On the other hand, because the first member 17 and the second member 18 are separated from each other at the border that includes the electrode-supporting section 115, the electrode-supporting section 115 is exposed to outside as shown in FIG. 5 in the detached state where the first member 17 and the second member 18 are detached from each other. Therefore, workability to the electrode-supporting section 115 can be increased by changing from the attached state to the detached state, and thereby the discharge electrode 12 can be installed easily on the electrode-supporting section 115. Moreover, in the embodiment, since entire mounting position on which the discharge electrode 12 is installed is exposed to outside in the detached state, workability in installing the discharge electrode 12 increases further. Accordingly, an electrostatic charger 10 and an image forming apparatus 1 provided with the same can be produced easily.

The conductive members 13, 14 are disposed on an inner surface of the housing 11, which is inner side faces 113, 114 of the first member 17 and the second member 18 respectively, in such a manner as to face each other sandwiching the discharge electrode 12 in between. The conductive members 13, 14 are respectively opposed parallelly to the discharge electrode 12. As an example, the conductive members 13, 14 are stuck onto the inner side faces 113, 114 of the first member 17 and the second member 18 respectively throughout their entire lengths with an adhesive. For the conductive members 13, 14, for example, metallic foil is used. Sheet metal can also be used for the conductive members 13, 14. The conductive members 13, 14 made of aluminum are preferred to prevent oxidation.

Despite the housing 11 made of resin, the conductive members 13, 14 disposed on the inner surface of the housing 11 increases stability of electric discharge by the discharge electrode 12. Although the conductive members 13, 14 are disposed on the inner surface of the housing 11, with the housing 11 split at the border that includes the electrode-supporting section 115, attaching positions of the conductive members 13, 14 are exposed to outside in the detached state of the first member 17 and the second member 18. As a result, the conductive members 13, 14 can be installed easily to the attaching positions of the first member 17 and the second member 18, respectively.

The grid electrode 15 is disposed on the open face 111's side, that is to say, so as to be located between the discharge electrode 2 and the photoreceptor drum 31.

Figure 6:
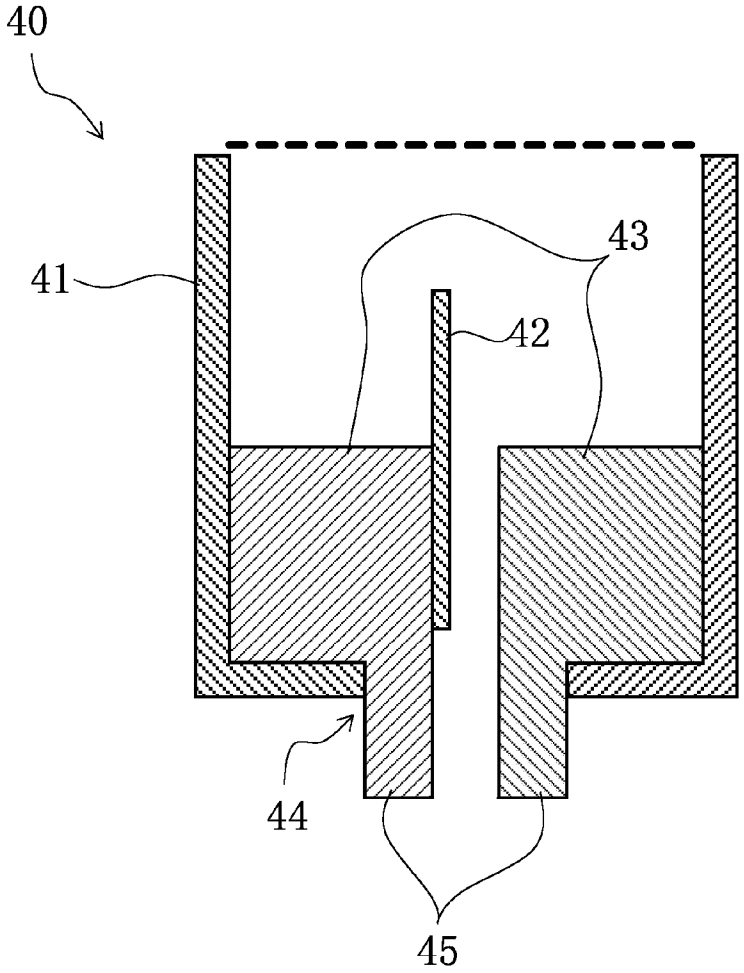
FIG. 6 is a general sectional view in the direction perpendicular to a longitudinal direction of an electrostatic charger according to a comparative example.

FIG. 6 shows an electrostatic charger 40 of a comparative example. In the electrostatic charger 40, a housing 41 is made of metal such as stainless steel, and an electrode-supporting section 43 onto which a discharge electrode 42 is installed is made of resin. The housing 41 has an opening section 44 on a face located on the opposite side of the photoreceptor drum 31.

In the electrostatic charger 40, in order to prevent failure in electrostatic charge due to sticking of nitrogen oxides to the tip portion of the discharge electrode 42 caused by ozone that is generated at the time of electric discharge, the discharge electrode 42 is installed in a pathway of an air current flowing in from the opening section 44. With the discharge electrode 42 disposed in the neighborhood of the opening section 44, ventilation around the discharge electrode 42 is enhanced.

On the other hand, in the electrostatic charger 40, because the housing 41 is made of metal and the discharge electrode 42 is disposed in the neighborhood of the opening section 44, it is necessary to prevent a leak current between the housing 41 and the discharge electrode 42. For this reason, in the electrostatic charger 40 is provided a rib 45 that is made of resin and projecting from the opening section 44 so as to be disposed between the housing 41 and the discharge electrode 42. Therefore, the electrostatic charger 40 is difficult to downsize.

On the other hand, in the electrostatic charger 10, because the housing 11 is made of resin, there is no risk of a leak current between the housing 11 and the discharge electrode 12 even when the discharge electrode 12 is disposed in the neighborhood of the opening section 16, so that there is no need to install the rib 45. Thus, the electrostatic charger 10 is easy to downsize.

Figure 7:
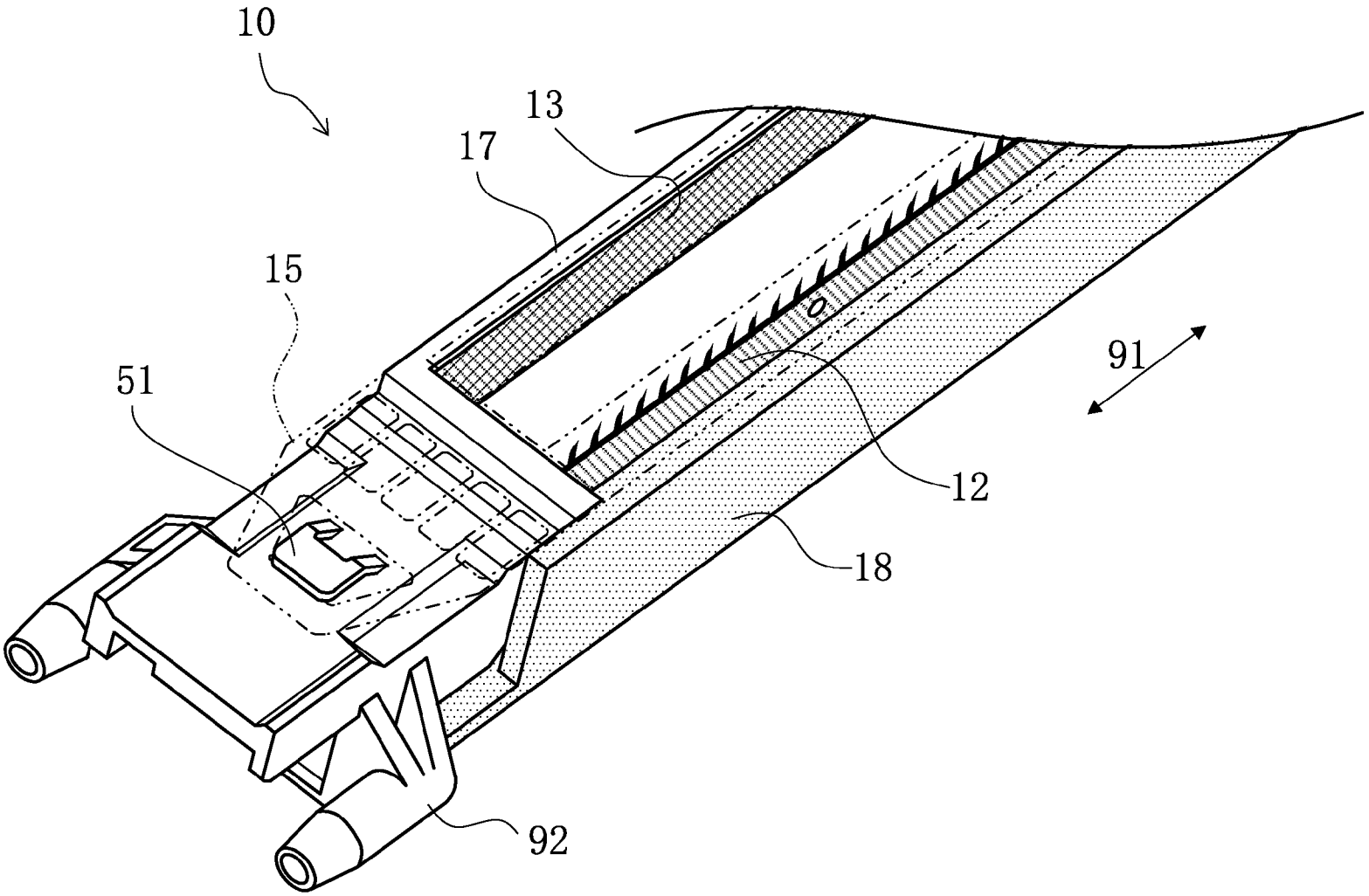
FIG. 7 is a perspective view from a front face's side of the first end portion of the electrostatic charger.

As shown in FIG. 7, the first member 17 is provided with a catching section 51 at a first end portion 92 in the longitudinal direction 91. As an example, the first end portion 92 is disposed on the front face's side of the image forming apparatus 1, whereas a second end portion 93 on the opposite side of the first end portion 92 in the longitudinal direction 91 is disposed on the rear face's side of the image forming apparatus 1.

Figure 8:
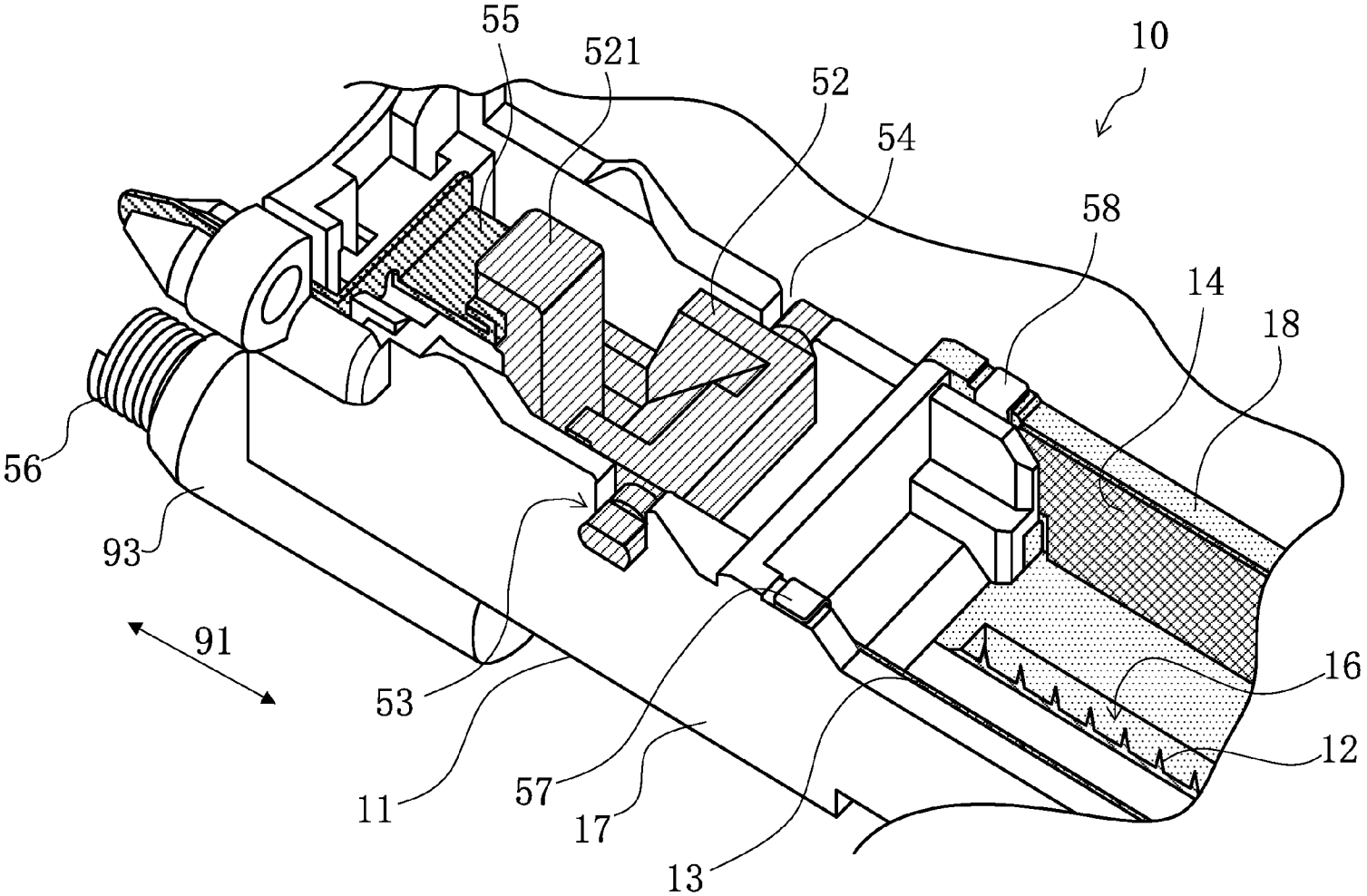
FIG. 8 is a perspective view from a front face's side of a second end portion of the electrostatic charger.
Figure 9:
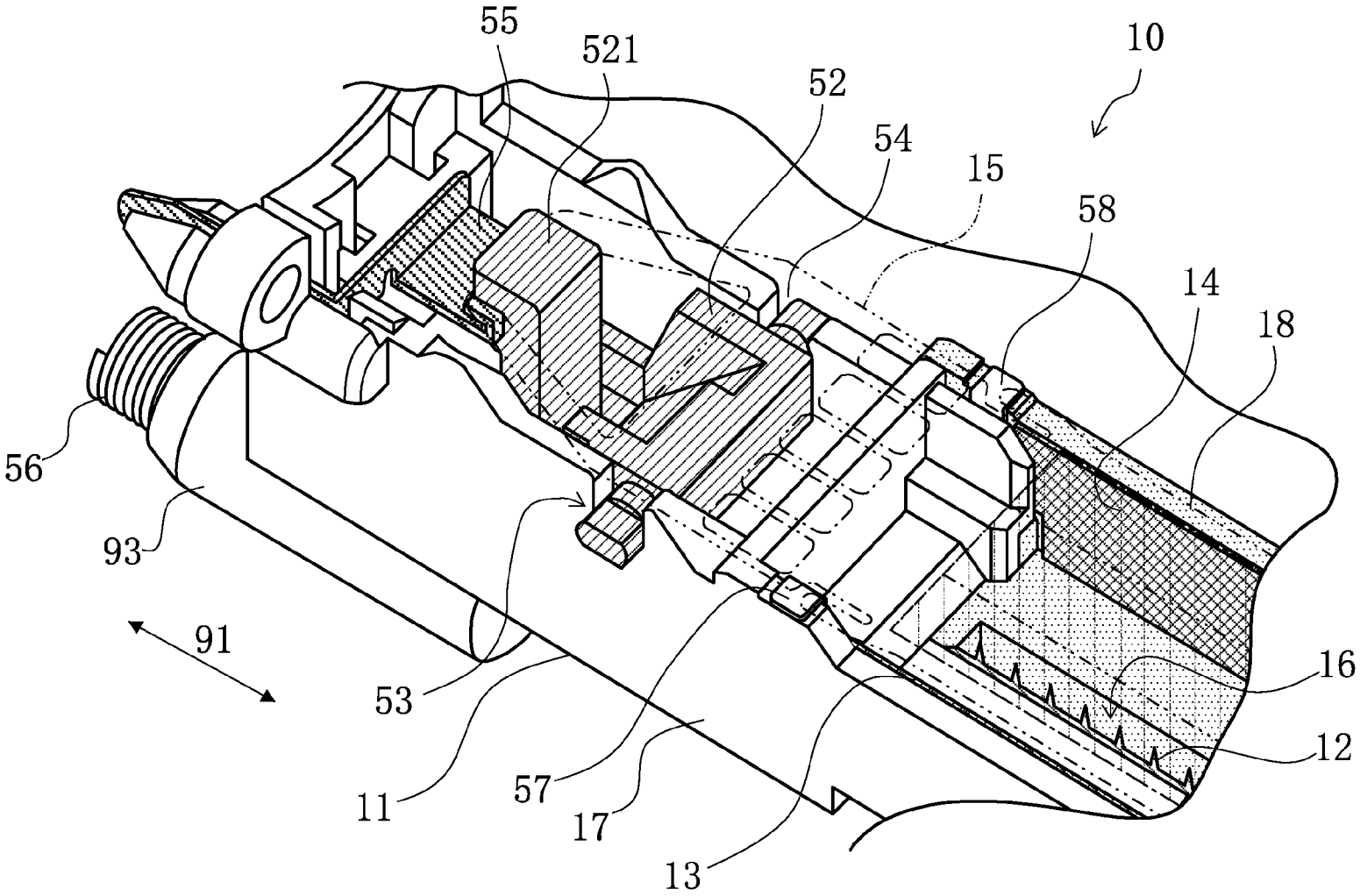
FIG. 9 is another perspective view from the front face's side of the second end portion of the electrostatic charger.

As shown in FIG. 8 and FIG. 9, the housing 11 is provided with a tension holder 52 at the second end portion 93. The tension holder 52 is supported at shaft thereof by recessed portions 53, 54 of the first member 17, and is rotatable around an axis in a direction perpendicular to the longitudinal direction 91. The tension holder 52 has a hook-shaped locking section 521.

The grid electrode 15 is attached to the housing 11 with a tensile force given thereto, by hooking one end portion of the grid electrode 15 to the catching section 51 and hooking the other end portion to the locking section 521 in a state where its upper part is inclined toward the catching section 51's side, and then by rotating the tension holder 52 in a direction where its upper part goes away from the catching section 51 and locking the tension holder 52 to the first member 17.

The tension holder 52 in its locked state that is shown in FIG. 8 and FIG. 9 sandwiches the grid electrode 15 between it and a first terminal 55. Applying a bias voltage to the first terminal 55 results in the bias voltage applied to the grid electrode 15. To the discharge electrode 12 is supplied an electric power from a second terminal 56.

The conductive member 13 has a first contact section 57 at an upper edge portion of the first member 17. The conductive member 14 has a second contact section 58 at an upper edge portion of the second member 18. The grid electrode 15 comes into contact with the first contact section 57 and the second contact section 58 in a state where it is attached to the housing 11, thereby connecting the conductive members 13, 14 to the grid electrode 15. This enables the bias voltage to be applied to the conductive members 13, 14 through the grid electrode 15. Because no electrical wiring is required to apply the bias voltage to the conductive members 13, 14 apart from the grid electrode 15, it is possible to reduce a manufacturing cost of the apparatus.

Figure 10:
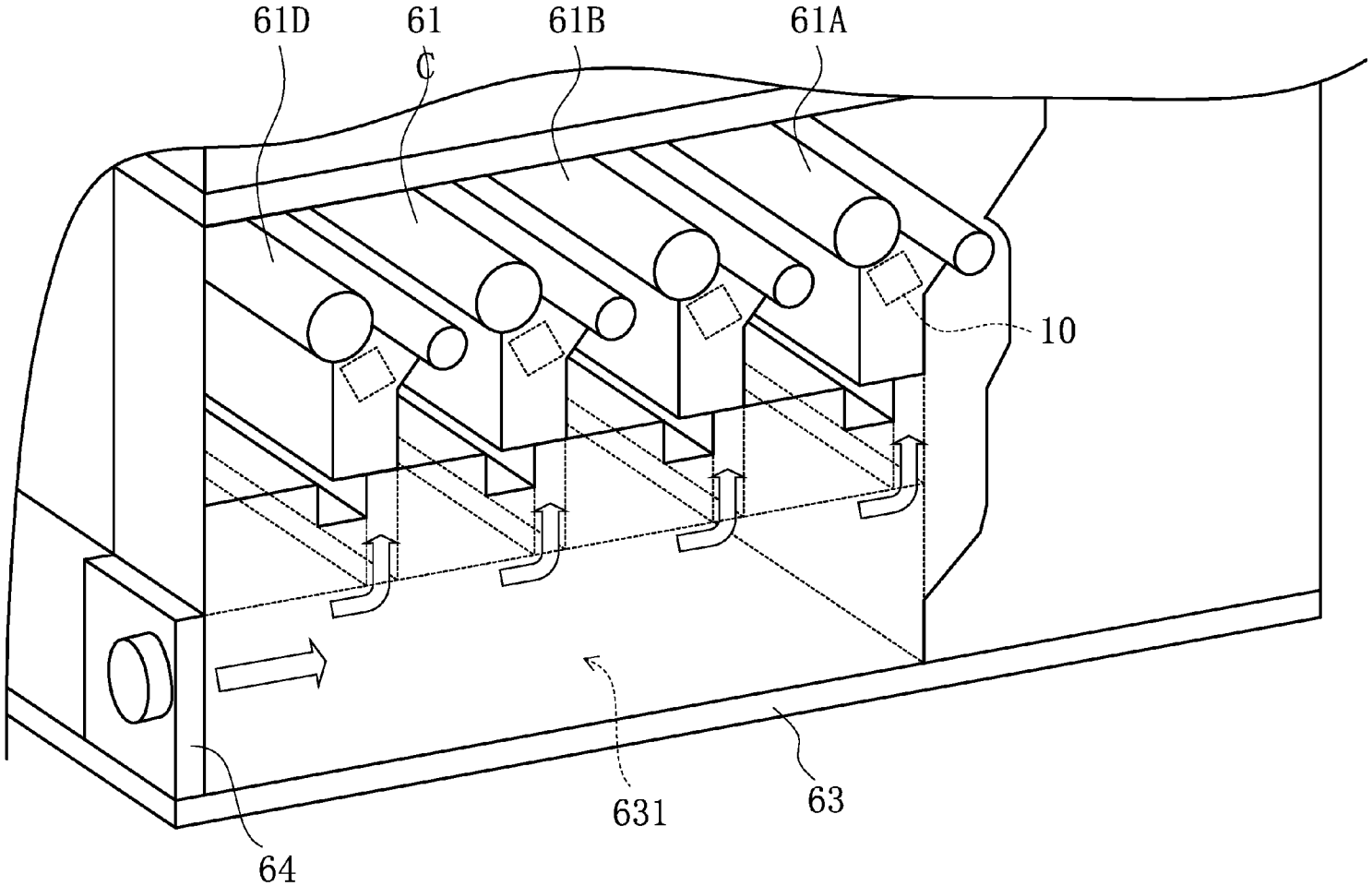
FIG. 10 is a perspective view of an internal structure of part of the image forming apparatus viewed from the front face's side.
Figure 11:
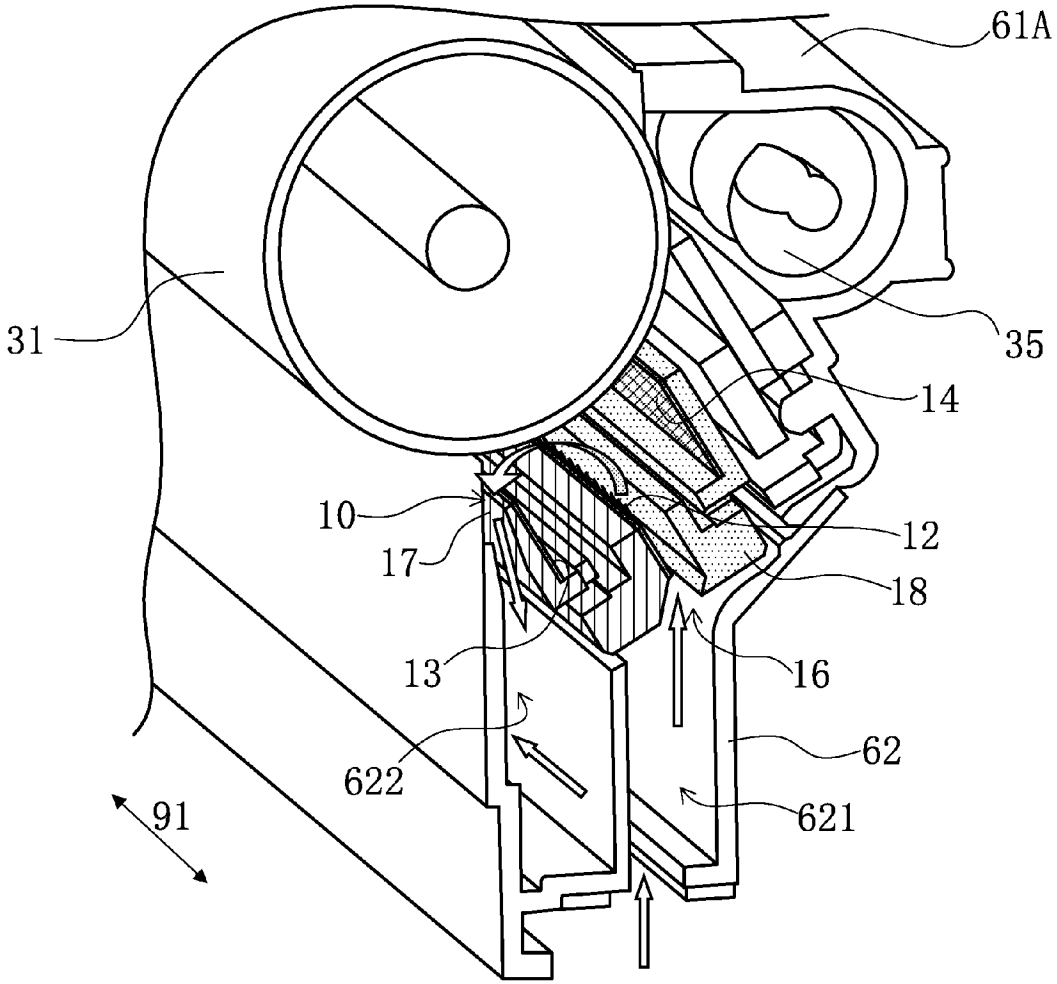
FIG. 11 is a perspective view of a cross sectional structure of part of the image forming apparatus viewed from the front face's side.

As shown in FIG. 10 and FIG. 11, as an example, the electrostatic charger 10, together with the photoreceptor drum 31 and the cleaning unit 35 and so forth, constitutes each of process units 61A, 61B, 61C, 61D, and is incorporated in each casing 62 of the respective process units 61A through 61D. The casing 62 is made of resin, for example, such as ABS resin (Acrylonitrile), Butadiene, Styrene interpolymerized synthetic resin). The electrostatic charger 10 is attachable to and detachable from the casing 62. Therefore, wear of the housing 11 at the time of its attachment to and detachment from the casing 62 of the electrostatic charger 10 is reduced as compared with the casing 62 made of metal. This results in suppressing deterioration of accuracy in the installation of the electrostatic charger 10 to the casing 62.

The image forming apparatus 1 includes a main body frame 63 and an air charging system 64. The air charging system 64 is disposed, as an example, on the front face's side of the image forming apparatus 1. The main body frame 63 is made of resin. The process units 61A through 61D are incorporated in the main body frame 63. The main body frame 63 has an external air supply duct 631 communicating the air charging system 64 with the respective process units 61A through 61D. The air charging system 64 supplies the air outside the image forming apparatus 1 to the respective process units 61A through 61D via the external air supply duct 631.

The casing 62 has an air supply duct 621 and an exhaust duct 622. The external air supply duct 631 communicates with the air supply duct 621. The air supplied into the air supply duct 621 flows into the housing 11 from the opening section 16 of the electrostatic charger 10, passes through the periphery of the discharge electrode 12, and then being exhausted from the open face, flows into the exhaust duct 622.

Figure 12:
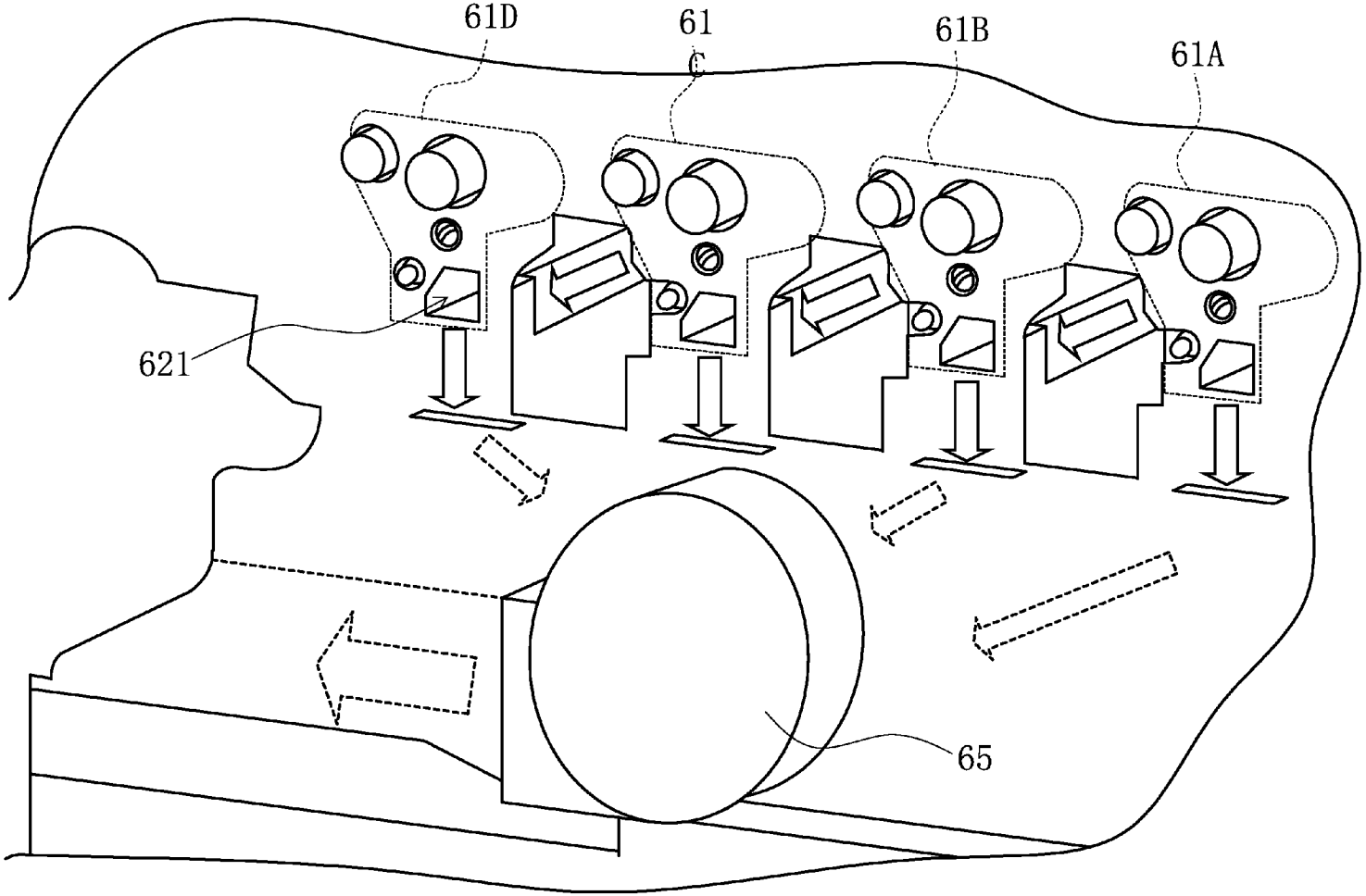
FIG. 12 is a perspective view of the internal structure of part of the image forming apparatus viewed from the rear face's side.

As shown in FIG. 12, the image forming apparatus 1 further includes an exhaust system 65. The exhaust system 65 is disposed, as an example, on the rear face's side of the image forming apparatus 1. The exhaust system 65 draws out the air in the respective exhaust ducts 622 of the process units 61A through 61D, and exhausts it outside the image forming apparatus 1.

The air charging system 64 and the exhaust system 65 respectively constitute an air current generator generating an air current in the opening section 16.

The air charging system 64 and the exhaust system 65 efficiently discharge the ozone generated around the discharge electrode 12 at the time of electric discharge, thereby suppressing the sticking of nitrogen oxides onto the discharge electrode 12. Therefore, failure in electrostatic charge on the photoreceptor drum 31 is suppressed.

Further, the image forming apparatus 1 can also be configured in such a manner that the electrostatic charger 10, the photoreceptor drum 31, the cleaning unit 35 and so forth are incorporated in the main body frame 63 without being provided with the casings 62 of the process units 61A through 61D. The electrostatic charger 10 is configured so as to be attachable to and detachable from the main body frame 63.

Because both the housing 11 and the main body frame 63 are made of resin, wear of the housing 11 at the time of attachment to and detachment from the main body frame 63 of the electrostatic charger 10 is reduced as compared with the main body frame 63 made of metal. Accordingly, deterioration of accuracy in the installation of the electrostatic charger 10 to the main body frame 63 is suppressed.

The above explanation of the embodiment is nothing more than illustrative in any respect, nor should be thought of as restrictive. Scope of the present invention is indicated by claims rather than the above embodiment. Further, it is intended that any changes that are equivalent to a claim in the sense and realm of the doctrine of equivalence be included within the scope of the present invention.

REFERENCE SIGNS LIST

1 Image forming apparatus
3A-3D Image forming section
10 Electrostatic charger
11 Housing
111 Open face
112 Inner bottom face
115 Electrode-supporting section
12 Discharge electrode
13, 14 Conductive member
15 Grid electrode
16 Opening section
17 First member
18 Second member
63 Main body frame
64 Air charging system
65 Exhaust system
91 Longitudinal direction

The invention claimed is:

1. An electrostatic charger comprising:

a discharge electrode which has a long shape; and a housing having a U-shaped cross section in a direction perpendicular to a longitudinal direction of the discharge electrode, the housing receiving the discharge electrode and supporting the discharge electrode in a direction such that a tip portion thereof is disposed on a open face's side, wherein the housing includes a first member and a second member separated from each other at a border that includes an electrode-supporting section supporting the discharge electrode, the first member and the second member are attachable to and detachable from each other, the housing includes an opening section provided on a face opposite the open face, the opening section being a slit-like opening section penetrating from the inside to the outside, and a side face of the opening section constitutes the electrode-supporting section, and wherein the housing is made of resin, the electrostatic charger further comprises a conductive member disposed on an inner surface of the housing in such a manner as to face the discharge electrode, the conductive member includes a first conductive member and a second conductive member, the first and second conductive members are respectively disposed on inner side surfaces of the first and second members, the inner side surfaces being included in the inner surface of the housing, and the first and second conductive members face each other so as to sandwich the discharge electrode in between.

2. The electrostatic charger as claimed in claim 1 ,further comprising a grid electrode disposed on the open face's side, wherein the conductive member has a contact section to which a bias voltage is applied through the grid electrode.

3. An image forming apparatus comprising:

an image bearing member; and the electrostatic charger as claimed in claim 1.

4. The image forming apparatus as claimed in claim 3, wherein a main body frame supporting the electrostatic charger is made of resin, and the electrostatic charger is attachable to and detachable from the main body frame.

5. The electrostatic charger as claimed in claim 1, wherein the first member and the second member are disposed so as to face each other to sandwich the discharge electrode in between in the direction perpendicular to the longitudinal direction.

6. The electrostatic charger as claimed in claim 1, wherein the opening section has a long and thin shape along the longitudinal direction.

7. The electrostatic charger as claimed in claim 1, wherein the opening section is formed between the first and second members.

* * * * *